US009441637B2

(12) United States Patent
Flückiger et al.

(10) Patent No.: US 9,441,637 B2
(45) Date of Patent: Sep. 13, 2016

(54) VOLUTE SHAPED PUMP CASING WITH SPLITTER RIB

(75) Inventors: Patrick Flückiger, Thayngen (CH); Arnaldo Rodrigues, Winterthur (CH)

(73) Assignee: Sulzer Management AG, Winterthur (CH)

( * ) Notice: Subject to any disclaimer, the term of this patent is extended or adjusted under 35 U.S.C. 154(b) by 493 days.

(21) Appl. No.: 13/696,302

(22) PCT Filed: Apr. 26, 2011

(86) PCT No.: PCT/EP2011/056568

§ 371 (c)(1),
(2), (4) Date: Nov. 5, 2012

(87) PCT Pub. No.: WO2011/138188

PCT Pub. Date: Nov. 10, 2011

(65) Prior Publication Data

US 2013/0058774 A1 Mar. 7, 2013

(30) Foreign Application Priority Data

May 7, 2010 (EP) ..... 10162342

(51) Int. Cl.
*F04D 29/54* (2006.01)
*F04D 29/42* (2006.01)
*F04D 29/44* (2006.01)

(52) U.S. Cl.
CPC ..... *F04D 29/428* (2013.01); *F04D 29/445* (2013.01); *Y10T 29/49243* (2015.01)

(58) Field of Classification Search
CPC .. F04D 29/422; F04D 29/428; F04D 29/441; F04D 29/445; Y10T 29/49243
USPC ..... 415/212.1, 204
See application file for complete search history.

(56) References Cited

U.S. PATENT DOCUMENTS 1,390,391 A 9/1921 Skidmore, Jr.
1,989,061 A 1/1935 Longenecker (Continued)

FOREIGN PATENT DOCUMENTS

GB 553045 5/1943

OTHER PUBLICATIONS

European Search Report mailed on Oct. 14, 2010 for EP Patent Application No. 10162342.9, 3 pages.

(Continued)

*Primary Examiner* — Eric Keasel
*Assistant Examiner* — Jason Mikus
(74) *Attorney, Agent, or Firm* — Kilpatrick Townsend & Stockton LLP

(57) ABSTRACT

A volute shaped pump casing for a centrifugal pump includes a chamber for housing at least one impeller rotatable around an axis of rotation and a volute shaped chamber which forms a flow channel and which contains a splitter rib for dividing the flow channel formed wherein in a section perpendicular to the axis of rotation a mean camber line is positioned equidistantly between an inner and outer surface of the splitter rib, where the thickness of the splitter rib is varied along the mean camber line and for the mean camber line unwrapped to a straight line there is a maximum in the thickness, s, of the splitter rib, wherein said maximum is positioned at a distance L from the leading edge of the splitter rib, and wherein the distance L is in the range between 1.4 times the maximum thickness s and 6 times the maximum thickness s.

18 Claims, 5 Drawing Sheets

(56) References Cited

U.S. PATENT DOCUMENTS

| | | | | | |
|---|---|---|---|---|---|
| 2,955,540 | A | * | 10/1960 | Pawlicki | 415/204 |
| 3,289,598 | A | * | 12/1966 | Buse et al. | 415/205 |
| 4,076,450 | A | | 2/1978 | Ross | |
| 4,893,986 | A | * | 1/1990 | Catterfeld et al. | 415/100 |
| 6,146,095 | A | | 11/2000 | Bross et al. | |

OTHER PUBLICATIONS

International Search Report mailed on Aug. 8, 2011 for PCT Patent Application No. PCT/EP2011/056568, 5 pages.

Written Opinion of the International Searching Authority mailed on Aug. 8, 2011 for PCT Patent Application No. PCT/EP2011/056568, 6 pages.

* cited by examiner

VOLUTE SHAPED PUMP CASING WITH SPLITTER RIB

CROSS-REFERENCES TO RELATED APPLICATIONS

This application is a U.S. National Phase under 35 USC 371 of PCT Application No. PCT/EP2011/056568, filed Apr. 26, 2011, which claims priority to the European Application No. 10162342.9, filed May 7, 2010, the disclosures of which are incorporated by reference herein.

BACKGROUND OF THE INVENTION

The invention relates to a volute shaped pump casing according to the preamble of claim 1, to a method of manufacturing a volute shaped pump casing according to the preamble of claim 9 and to a centrifugal pump including such a volute shaped pump casing.

Volute casing pumps are very common. Their characteristic feature is the volute-shaped pump casing which, as a rule, makes this pump type recognizable from the outside. A cross section through a typical volute-shaped pump casing is shown in FIG. 1A. Volute casing pumps are usually single stage. Two stage and multistage volute casing pumps are used less frequently. In some applications a volute shaped casing is provided only for the last stage. Single suction and double suction volute casing pumps are both used frequently.

A volute shaped casing generally includes a chamber designed to house at least one impeller being usually of the radial or mixed flow type and mounted on a shaft for rotation when driven by a motor. The casing further includes a volute shaped chamber section to collect pumped medium and a discharge channel section to guide the medium out. The discharge channel section can be arranged tangentially to the volute casing, or arranged radially by providing a swan neck. A suction channel section is favorably arranged axially in case of bearings arranged only at one side of the impeller, and radially or tangentially in case of bearings at either side of the impeller.

In its simplest embodiment of a single volute, the casing can be broadly sub-divided into two main sections consisting of a downstream chamber section and the upstream discharge channel section. The plane or section at which the chamber and channel meet is generally defined as the throat. The leading edge of the throat which separates or guides the flow from the chamber into the channel is designated cutwater lip or cut water and for any given length the top and bottom surface extending beyond the lip is termed the tongue. In the case of a casing with a plurality of volutes or flow channels disposed around an impeller the number of lips will usually be equal to the number of volutes or flow channels. In such cases the wall separating two neighboring flow channels such as a volute shaped chamber section and a neighboring discharge channel section is named a rib or splitter rib or splitter rib wall.

On rotation a radial thrust is generated in centrifugal pumps by the interaction of the impeller and the pump casing. In a volute casing pump having a single volute the radial thrust becomes a minimum when the pump is operated at the best efficiency point. When the pump is operated off the best efficiency point the radial thrust increases. Volute casing pumps having two or more volutes disposed around an impeller were developed to reduce the radial thrust generated by operating the pump off the best efficiency point. The splitter ribs provided in the casing of such pumps can influence the stability in the head performance curve and instabilities in the head performance curve can manifest in such pumps. This is thought to be due to flow separation at either side of the splitter rib.

A curved splitter rib with a given thickness can be defined along a mean camber line (see e.g. FIG. 2). The mean camber line is a reference design line equidistantly positioned at all points between the upper and lower surfaces of the splitter rib. For ease of interpretation and design the mean camber line of a curved splitter rib can be unwrapped to a straight line. The result is that the top and bottom surfaces of the splitter rib are always symmetric along this mean camber line regardless of what the upper and lower surface profiles looked like in the wrapped configuration.

In the current state of technology the splitter rib designs incorporate a constant or variable thickness along its length. In the case of splitter ribs with a constant thickness t, the position at which the thickness starts to be constant is at a distance L' from the leading edge of the splitter rib, with L' being measured in the direction of the unwrapped mean camber line and being smaller than 1.2 times the constant thickness t (see FIGS. 4A-4C). In case of splitter ribs with variable thickness, on the other hand, the maximum thickness position will be located at a wrap angle higher than 60 degrees starting from the leading edge of the splitter rib. The conventional splitter rib design has, however, not been able to overcome the instability in the head performance curve described above.

BRIEF SUMMARY OF THE INVENTION

It is an object of the present invention to provide a volute shaped pump casing, a method of manufacturing a volute shaped pump casing and a centrifugal pump including such a volute shaped pump casing wherein the stability in the head performance curve can be improved compared to corresponding conventional volute casing pumps.

This object is satisfied in accordance with the invention by the volute shaped pump casing defined in claim 1, the method of manufacturing a volute shaped pump casing defined in claim 9 and by the centrifugal pump defined in claim 12.

The volute shaped pump casing for a centrifugal pump according to the invention includes a chamber for housing at least one impeller rotatable around an axis of rotation and further includes a volute shaped chamber which forms a flow channel and which contains a splitter rib for dividing the flow channel formed, e.g. into at least two volute shaped chamber sections. The volute shaped pump casing is characterized in that in a section perpendicular to the axis of rotation a mean camber line is positioned equidistantly between an inner and outer surface of the splitter rib, in that the thickness of the splitter rib is varied along the mean camber line and for the mean camber line unwrapped to a straight line there is a maximum in the thickness of the splitter rib, with the thickness at said maximum being called maximum thickness s, and in that said maximum is positioned at a distance L from the leading edge of the splitter rib wherein the distance L is favorably measured in the direction of the unwrapped mean camber line and is larger than 1.4 times the maximum thickness s and smaller than 6 times the maximum thickness s. Written as a formula the distance L is in the range $$1.4s<L<6s$$

Depending on pump specification the distance L can be made larger than 1.5 times the maximum thickness s and smaller than 5 times the maximum thickness s or even larger than 1.8 times the maximum thickness s and smaller than 4.5 times the maximum thickness s.

The splitter rib can have a thickness equal to the maximum thickness s along a part of the splitter rib, especially if this part is positioned inside of the above specified range of the distance L, with the distance L being measured from the leading edge of the splitter rib in the direction of the unwrapped mean camber line. In an advantageous embodiment variant the splitter rib has a thickness smaller than the maximum thickness s adjacent to the maximum. In a further advantageous embodiment variant the thickness of the splitter rib is smaller than the maximum thickness s for a distance from the leading edge of the splitter rib just outside or next to the range of the distance L given above. The splitter rib can e.g. have a thickness outside the range of the distance L given above which is 8% or 5% or 3% smaller than the maximum thickness s at a distance of half of the maximum thickness s from the range boundaries of the distance L given above.

In an advantageous embodiment of the volute shaped pump casing the splitter rib has a leading edge part, wherein at the leading edge part the inner and outer surface of the splitter rib each have a different angle when the splitter rib is wrapped along a curvature in the volute shaped chamber. In a further advantageous embodiment of the volute shaped pump casing the splitter rib includes a leading edge part, wherein at the leading edge part the inner and outer surface of the splitter rib are matched to the inner and outer flow approach angle respectively when the splitter rib is wrapped along a curvature in the volute shaped chamber.

In another advantageous embodiment of the volute shaped pump casing the splitter rib is made from one piece, except for an optional split of the splitter rib caused by a split 3.1 of the pump casing. In other words, the splitter rib 3 is only made from more than one piece if the splitter rib is split because of a split of the pump casing. Volute shaped pump casings are typically split in axial or radial direction to ease manufacturing. Thus, the splitter rib may e.g. be split by an axial or radial plane.

In still another advantageous embodiment of the volute shaped pump casing the splitter rib is fully manufactured from metal such as casted metal. In addition, the splitter rib and/or the interior of the pump casing may e.g. be coated with an organic or inorganic coating such as a ceramic or metallic coating.

Independent of the embodiment or embodiment variant the splitter rib favorably forms an integral part with the volute shaped chamber and/or with the volute shaped pump casing.

The method of manufacturing a volute shaped pump casing according to the invention for a centrifugal pump with a chamber for housing at least one impeller rotatable around an axis of rotation and with a volute shaped chamber which forms a flow channel and which contains a splitter rib for dividing the flow channel formed is characterized in that the method includes positioning a mean camber line equidistantly between an inner and outer surface of the splitter rib in a section perpendicular to the axis of rotation, varying the thickness of the splitter rib along the mean camber line, providing a maximum in the thickness of the splitter rib for the mean camber line unwrapped to a straight line, with the thickness at said maximum being called maximum thickness s, and positioning said maximum at a distance L from the leading edge of the splitter rib wherein the distance L is favorably measured in the direction of the unwrapped mean camber line and is larger than 1.4 times the maximum thickness s and smaller than 6 times the maximum thickness s.

In an advantageous embodiment of the method the volute shaped pump casing and the whole splitter rib or part of the splitter rib are formed together. In a further advantageous embodiment of the method the volute shaped pump casing and the whole splitter rib or part of the splitter rib are formed by casting.

In another advantageous embodiment of the method the splitter rib is formed from one piece, except for an optional split of the splitter rib caused by a split of the pump casing. In still another advantageous embodiment of the method the splitter rib is fully manufactured from metal such as casted metal. In addition, the splitter rib may e.g. be coated with an organic or inorganic coating such as a ceramic or metallic coating.

The invention further includes a centrifugal pump having a volute shaped pump casing according to one of the embodiments and embodiment variants described above.

The volute shaped pump casing, the method of manufacturing a volute shaped pump casing and the centrifugal pump according the invention have the advantage that they allow to improve the stability of the head performance curve due to the greater flexibility in matching the inner and outer flow approach angle to the respective surfaces of the splitter rib. This minimizes the risk of flow separation at either side of the rib which can also manifest in pump vibrations. The volute shaped pump casing, the method of manufacturing a volute shaped pump casing and the centrifugal pump according the invention have the added ability of controlling the shut-off head with the change of the upper and lower surface camber angles within the distance L from the leading edge of the splitter rib. Furthermore minimizing flow separation advantageously increases the diffusion capability of the casing due to minimized secondary losses. The splitter rib design described above also means locally increased thickness where highest residual stresses are usually observed and reduced thickness for the remaining length of the splitter rib where the large thickness required at the start of the splitter rib would tend to be oversized. When the position of maximum thickness of the splitter rib is outside the above specified range and closer to the leading edge of the splitter rib the stabilizing effect on the head performance curve becomes weak or negligible. When the position of maximum thickness of the splitter rib is beyond the above specified range the stabilizing effect on the head performance curve becomes weaker and/or the efficiency decreases.

The above description of the embodiments and variants serves merely as an example. Further advantageous embodiments can be seen from the dependent claims and the drawing. Moreover, in the context of the present invention, individual features from the described or illustrated embodiments and from the described or illustrated variants can be combined with one another in order to form new embodiments.

In the following the invention will be explained in more detail with reference to the specific embodiment and with reference to the drawing.

DETAILED DESCRIPTION OF THE INVENTION

Figure 1A:
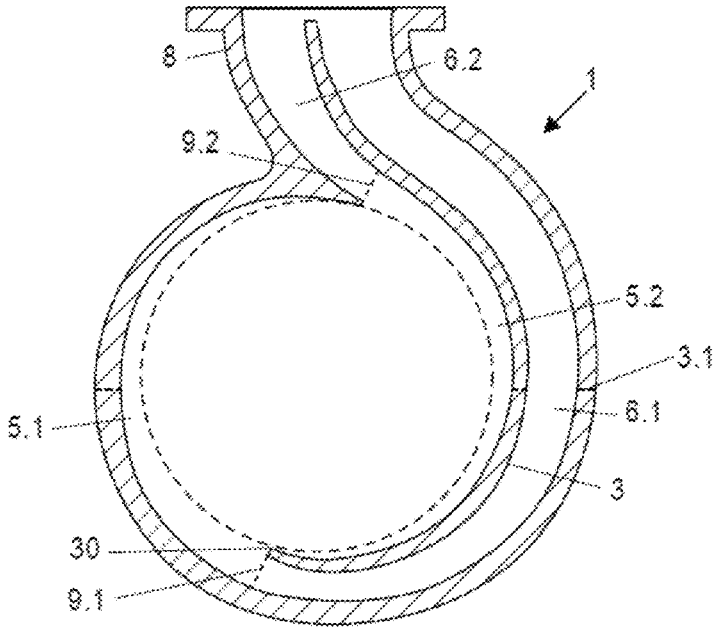
FIG. 1A is a section perpendicular to the axis of rotation through a conventional volute shaped pump casing having a splitter rib.

FIG. 1A shows a section perpendicular to the axis of rotation through a conventional volute shaped pump casing 1 for a centrifugal pump. The volute shaped pump casing includes a chamber for housing at least one impeller rotatable around an axis of rotation and further includes a volute shaped chamber which forms a flow channel and which contains a splitter rib 3 with a leading edge 3*a* for dividing the flow channel, e.g. into at least two volute shaped chamber sections 5.1, 5.2 called outer and inner volute shaped chamber sections in the following. In the assembled state of the pump the outer and inner volute shaped chamber sections are disposed around the at least one impeller and typically extend each over about half or part of the circle. The flow channel formed can further include an outer channel 6.1 and inner channel 6.2 upstream of the outer and inner volute shaped chamber sections 5.1, 5.2 respectively. The volute shaped pump casing usually further includes a discharge duct 8 which can be arranged radially as shown in FIG. 1A. Moreover, there is a throat 9.1, 9.2 defined each where the outer and inner volute shaped chamber sections meet the outer and inner channel respectively.

Figure 1B:
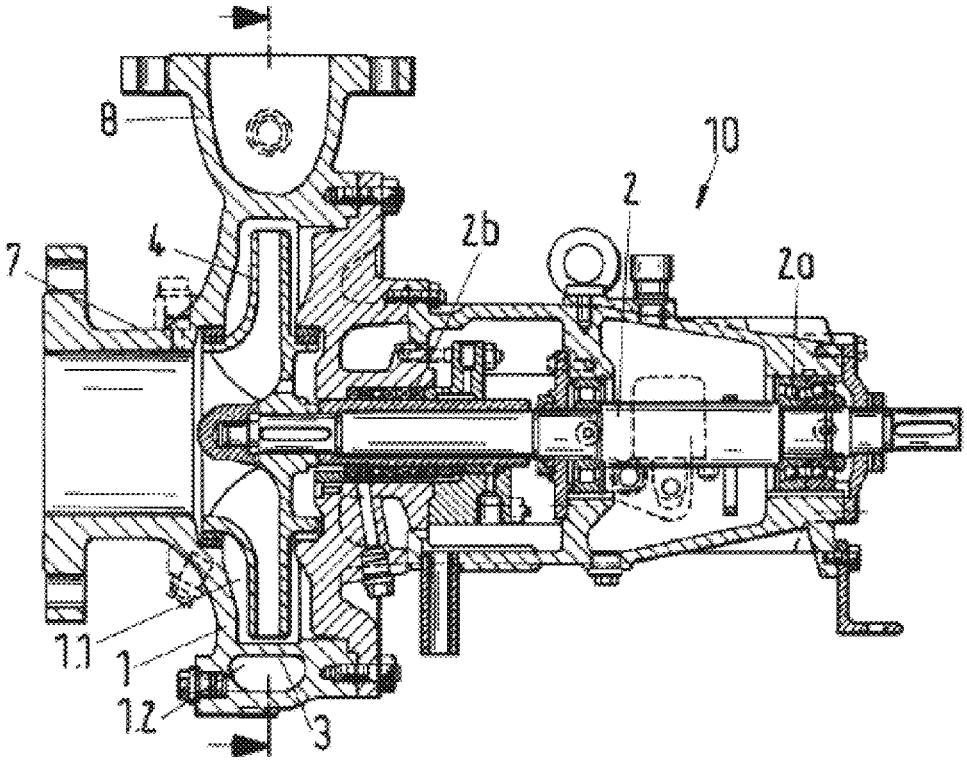
FIG. 1B is an axial section through a conventional centrifugal pump having a volute shaped pump casing in accordance with FIG. 1A.

FIG. 1B shows an axial section through a conventional centrifugal pump 10 having a volute shaped pump casing in accordance with FIG. 1A. The volute shaped pump casing 1 includes a chamber 1.1 for housing at least one impeller 4 rotatable around an axis of rotation and further includes a volute shaped chamber 1.2 which forms a flow channel and which contains a splitter rib 3 for dividing the flow channel. The impeller is usually mounted on a shaft 2 for rotation when driven by a motor. The shaft 2 can be supported by bearings 2*a*. In addition, a seal 2*b* such as a package seal can be provided for sealing the shaft against the pump casing. The volute shaped pump casing favorably includes a discharge channel section 8 to guide the medium to be pumped out. The discharge channel section can be arranged tangentially to the volute casing, or arranged radially by providing a swan neck as shown in FIG. 1A. The volute shaped pump casing can further include a suction channel section 7 which is favorably arranged axially in case of the centrifugal pump shown.

Figure 2:
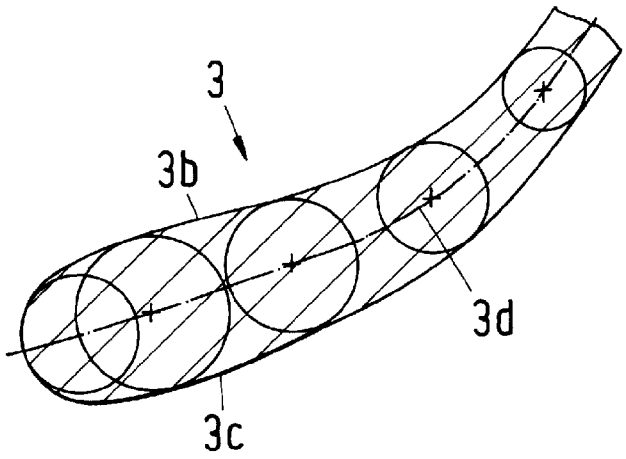
FIG. 2 is a detailed view of a section perpendicular to an axis of rotation through an arbitrary splitter rib wrapped.

FIG. 2 shows a detailed view of a section perpendicular to an axis of rotation through an arbitrary splitter rib 3 having an inner and outer surface 3*b*, 3*c*. In the section shown the inner and outer surface 3*b*, 3*c* define surface lines which can be thought as an envelope line of a large number of circles which contact the surface lines from the inside. The centers of these circles define a reference design line 3*d* called mean camber line in the following. The mean camber line 3*d* is equidistantly positioned at all points between the inner and outer surfaces of the splitter rib 3.

Figure 3:
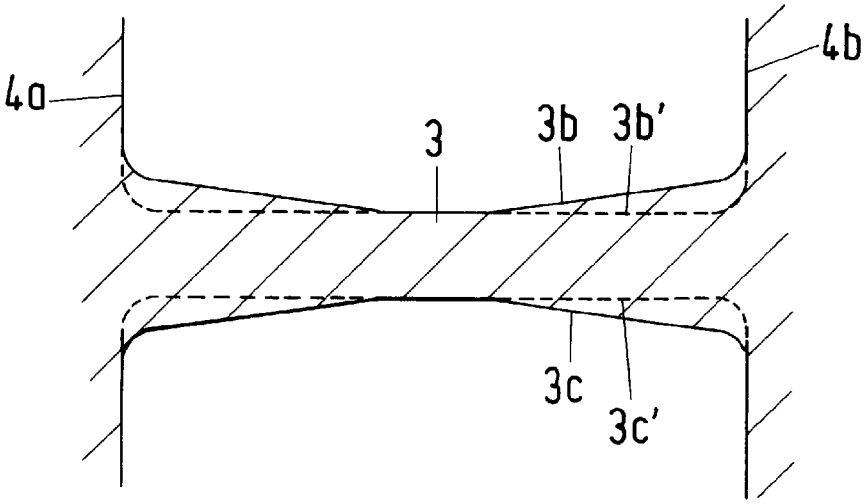
FIG. 3 is a detailed view of an axial section through a splitter rib and adjacent side walls of a conventional volute shaped pump casing.

A detailed view of an axial section through a splitter rib 3 and through adjacent side walls 4*a*, 4*b* of a conventional volute shaped pump casing is shown in FIG. 3. The splitter rib shown has an inner or upper surface and outer or lower surface. Surface lines of two differently formed surfaces 3*b*, 3*c* and 3*b*', 3*c*' are shown in FIG. 3 by full and broken lines respectively. The axial cross section of the splitter rib can for example be tapered towards the center between the side walls as shown by full surface lines in FIG. 3 or the axial cross section can be made essentially rectangular as shown by broken surface lines.

Figure 4A:
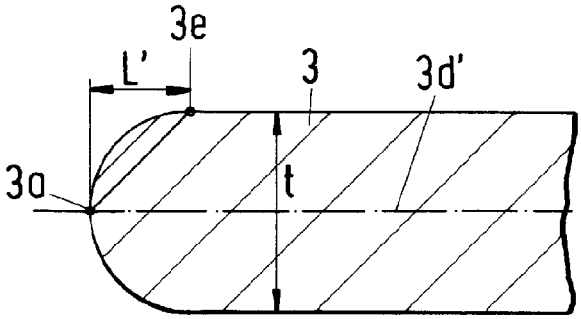
FIG. 4A-C are detailed views of sections perpendicular to an axis of rotation through three different conventional splitter ribs unwrapped.
Figure 4B:
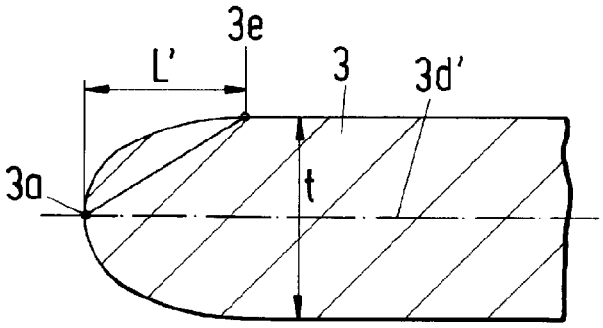
Figure 4C:
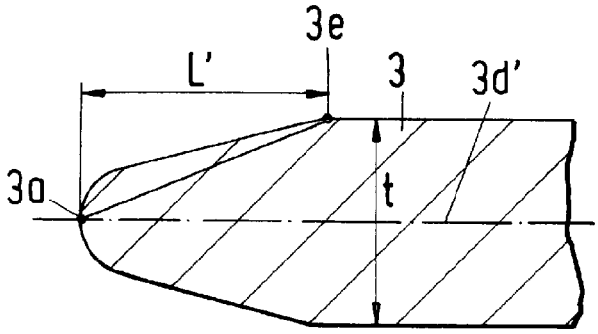

FIGS. 4A to 4C show detailed views of sections perpendicular to an axis of rotation through three different conventional splitter ribs 3 incorporating a constant thickness t along its length except for a rounding off at the leading edges and usually also at the trailing edges (not shown in FIGS. 4A to 4C). For each splitter rib 3 shown a mean camber line 3*d*' is defined as described in connection with FIG. 2 above. For ease of interpretation and design the mean camber lines 3*d*' are unwrapped to a straight line in FIGS. 4A to 4C.

The splitter rib 3 shown in FIG. 4A is rounded off circularly at the leading edge 3*a*, i.e. the position 3*e* at which the thickness starts to be constant is at a distance L' from the leading edge of the splitter rib, with L' being about half of the constant thickness t. For each of the splitter ribs shown in FIGS. 4A to 4C the distance L' is measured in the direction of the unwrapped mean camber line 3*d*'. The splitter rib 3 further shown in FIG. 4B is rounded off in ellipse form at the leading edge 3*a* and the position 3*e* at which the thickness starts to be constant is at a distance L' from the leading edge of the splitter rib, with L' being between half of the constant thickness t and 0.8 times the thickness t. The splitter rib 3 shown furthermore in FIG. 4C is chamfered at the leading edge 3*a* and the position 3*e* at which the thickness starts to be constant is at a distance L' from the leading edge of the splitter rib, with L' being smaller or equal to 1.2 times the constant thickness t. Moreover, the splitter ribs shown in FIGS. 4B and 4C can incorporate a fillet at the leading edge when required.

The volute shaped pump casing for a centrifugal pump according to the invention is explained with reference to FIGS. 1A and 5A. The volute shaped pump casing 1 in accordance with the invention includes a chamber for housing at least one impeller rotatable around an axis of rotation and further includes a volute shaped chamber which forms a flow channel and which contains a splitter rib 3 for dividing the flow channel, e.g. into at least two volute shaped chamber sections. The volute shaped pump casing 1 is characterized in that in a section perpendicular to the axis of rotation a mean camber line is positioned equidistantly between an inner and outer surface of the splitter rib 3, in that the thickness of the splitter rib is varied along the mean camber line and for the mean camber line unwrapped to a straight 3*d*' line there is a maximum in the thickness of the splitter rib, with the thickness at said maximum being called maximum thickness s, and in that said maximum is positioned at a distance L from the leading edge 3*a* of the splitter rib wherein the distance L is favorably measured in the direction of the unwrapped mean camber line 3*d*' and is larger than 1.4 times the maximum thickness s and smaller than 6 times the maximum thickness s.

Figure 5A:
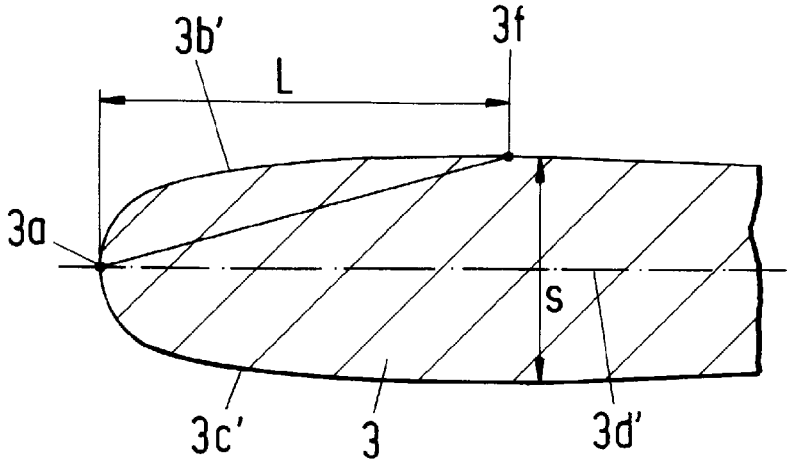
FIG. 5A is a detailed view of a section perpendicular to an axis of rotation through an embodiment of a splitter rib according to the invention, with the mean camber line unwrapped to a straight line.

A detailed view of a section perpendicular to the axis of rotation through an embodiment of a splitter rib of a volute shaped pump casing according to the invention is shown in FIG. 5A. For the splitter rib 3 shown a mean camber line is defined as described in connection with FIG. 2 above. For ease of interpretation and design the mean camber line is unwrapped to a straight line 3*d*' in FIG. 5A. In the section shown the inner and outer surface 3*b*', 3*c*' define upper and lower surface lines respectively. The splitter rib 3 is typically rounded off at the leading edge 3*a*. The thickness of the splitter rib is varied along the mean camber line and for the mean camber line unwrapped to a straight line 3*d*' there is a maximum in the thickness of the splitter rib at a position 3*f*, with the thickness at said maximum being called maximum thickness s. Said maximum is positioned at a distance L from the leading edge 3*a* of the splitter rib wherein the distance L is favorably measured in the direction of the unwrapped mean camber line 3*d*' and is larger than 1.4 times the maximum thickness s and smaller than 6 times the maximum thickness s. Written as a formula the distance L is in the range $$1.4s<L<6s$$

Depending on pump specification the distance L can be made larger than 1.5 times the maximum thickness s and smaller than 5 times the maximum thickness s or even larger than 1.8 times the maximum thickness s and smaller than 4.5 times the maximum thickness s.

The splitter rib 3 can have a thickness equal to the maximum thickness s along a part of the splitter rib, especially if this part is positioned inside of the above specified range of the distance L, with the distance L being measured from the leading edge 3*a* of the splitter rib in the direction of the unwrapped mean camber line 3*d*'. In an advantageous embodiment variant the splitter rib 3 has a thickness smaller than the maximum thickness s adjacent to the maximum.

In a further advantageous embodiment variant the thickness of the splitter rib 3 is smaller than the maximum thickness s for a distance from the leading edge 3*a* of the splitter rib just outside or next to the range of the distance L given above. The splitter rib 3 can e.g. have a thickness outside the range of the distance L given above which is 8% or 5% or 3% smaller than the maximum thickness s at a distance of half of the maximum thickness s from the range boundaries of the distance L given above.

Figure 5B:
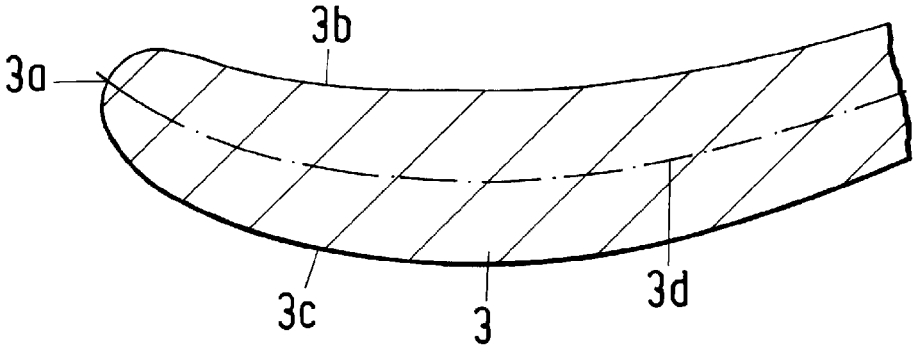
FIG. 5B is a detailed view of a section perpendicular to an axis of rotation through an embodiment of a splitter rib according to the invention, with the mean camber line wrapped along a curvature.

FIG. 5B shows further detailed view of a section perpendicular to an axis of rotation through an embodiment of a splitter rib according to the invention. For the splitter rib 3 shown a mean camber line 3*d* is defined as described in connection with FIG. 2 above, with the mean camber line being wrapped along a curvature in the volute shaped chamber. In the section shown the inner and outer surface 3*b*, 3*c* define upper and lower surface lines respectively. The splitter rib 3 is typically rounded off at the leading edge 3*a* and the thickness of the splitter rib is varied along the mean camber line 3*d*.

In an advantageous embodiment of the volute shaped pump casing 1 the splitter rib 3 has a leading edge part, e.g. a leading edge part including the above specified range of distance L when measured on the wrapped mean camber line, wherein at the leading edge part the inner and outer surface 3*b*, 3*c* of the splitter rib each have a different angle when the splitter rib is wrapped along a curvature in the volute shaped chamber. In a further advantageous embodiment of the volute shaped pump casing 1 the splitter rib 3 includes a leading edge part, e.g. a leading edge part including the above specified range of distance L when measured on the wrapped mean camber line, wherein at the leading edge part the inner and outer surface 3*b*, 3*c* of the splitter rib are matched to the inner and outer flow approach angle respectively when the splitter rib is wrapped along a curvature in the volute shaped chamber.

In another advantageous embodiment of the volute shaped pump casing the splitter rib 3 is made from one piece, except for an optional split of the splitter rib caused by a split of the pump casing 1. Volute shaped pump casings are typically split in axial or radial direction to ease manufacturing. Thus, the splitter rib 3 may e.g. be split by an axial or radial plane.

In still another advantageous embodiment of the volute shaped pump casing the splitter rib 3 is fully manufactured from metal such as casted metal. In addition, the splitter rib 3 may e.g. be coated with an organic or inorganic coating such as a ceramic or metallic coating.

Independent of the embodiment or embodiment variant the splitter rib 3 favorably forms an integral part with the volute shaped chamber and/or with the volute shaped pump casing 1.

The method of manufacturing a volute shaped pump casing according to the invention is described with reference to FIGS. 1A and 5A. The method of manufacturing a volute shaped pump casing 1 for a centrifugal pump with a chamber for housing at least one impeller rotatable around an axis of rotation and with a volute shaped chamber which forms a flow channel and which contains a splitter rib 3 for dividing the flow channel formed includes positioning a mean camber line equidistantly between an inner and outer surface of the splitter rib 3 in a section perpendicular to the axis of rotation, varying the thickness of the splitter rib along the mean camber line, providing a maximum in the thickness of the splitter rib for the mean camber line unwrapped to a straight line 3*d*', with the thickness at said maximum being called maximum thickness s, and positioning said maximum at a distance L from the leading edge 3*a* of the splitter rib wherein the distance L is favorably measured in the direction of the unwrapped mean camber line 3*d*' and is larger than 1.4 times the maximum thickness s and smaller than 6 times the maximum thickness s.

In an advantageous embodiment of the method the volute shaped pump casing 1 and the whole splitter rib 3 or part of the splitter rib are formed together. In a further advantageous embodiment of the method the volute shaped pump casing 1 and the whole splitter rib 3 or part of the splitter rib are formed by casting. The final profile can e.g. be achieved by attaching pieces and/or fixtures which embody the final profile if part of the splitter rib is formed by casting.

In another advantageous embodiment of the method the splitter rib 3 is formed from one piece, except for an optional split of the splitter rib caused by a split of the pump casing 1. In still another advantageous embodiment of the method the splitter rib 3 is fully manufactured from metal such as casted metal. In addition, the splitter rib 3 may e.g. be coated with an organic or inorganic coating such as a ceramic or metallic coating.

The invention further includes a centrifugal pump 10 having a volute shaped pump casing 1 according to one of the embodiments and embodiment variants described above.

Figure 6A:
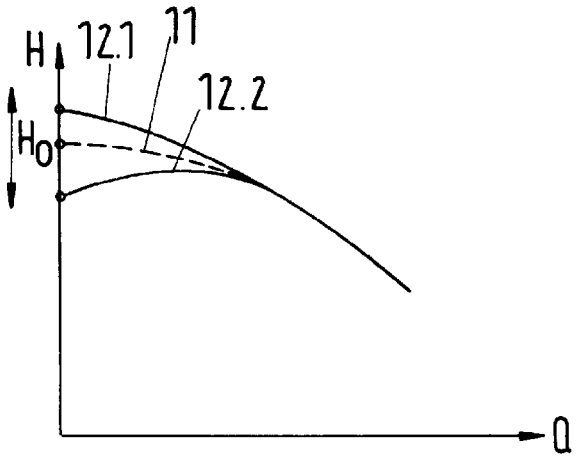
FIG. 6A is a diagram of head performance curves of volute casing pumps according to prior art and according to the invention.

A diagram of head performance curves of volute casing pumps according to prior art and according to the invention are shown in FIG. 6A. The diagram shows the pump head H as a function of volume flow Q. A first head performance curve 11 of a volute casing pump according to prior art exhibits a medium shut off head. A second and third head performance curve 12.1. 12.2 of a volute casing pump according to the invention exhibit shut off heads being higher and lower than the shut off head of the curve 11. Thus, the design of the splitter rib of the volute shaped pump according to the invention allows controlling the shut-off head in a range $H_0$ by changing the camber angles.

Figure 6B:
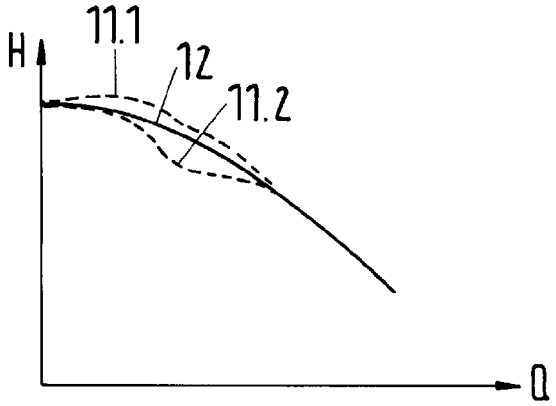
FIG. 6B is a second diagram of different head performance curves of volute casing pumps according to prior art and according to the invention.

A second diagram of head performance curves of volute casing pumps according to prior art and according to the invention are shown in FIG. 6B. The diagram shows the pump head H as a function of volume flow Q. A first and second head performance curve 11.1, 11.2 of two volute casing pumps according to prior art clearly exhibit instabilities while a third head performance curve 12 of a volute casing pump according to the invention exhibits a stable behavior due to the splitter rib design features described in connection with FIGS. 5A and 5B above.

The invention claimed is:

1. A volute shaped pump casing for a centrifugal pump including a chamber for housing at least one impeller rotatable around an axis of rotation and including a volute shaped chamber which forms a flow channel and which contains a splitter rib for dividing the flow channel formed, characterized in that in a section perpendicular to the axis of rotation a mean camber line is positioned equidistantly between an inner and outer surface of the splitter rib, in that the thickness of the splitter rib is varied along the mean camber line and for the mean camber line unwrapped to a straight line there is a maximum in the thickness of the splitter rib, with the thickness at said maximum being called maximum thickness s, and in that said maximum is positioned at a distance L from the leading edge of the splitter rib wherein the distance L is in the range between 1.4 times the maximum thickness s and 6 times the maximum thickness s, wherein for a distance from the leading edge of the splitter rib just outside the range of the distance L the thickness of the splitter rib is smaller than the maximum thickness s.

2. A volute shaped pump casing according to claim 1, wherein the distance L is in the range between 1.5 times the maximum thickness s and 5 times the maximum thickness s.

3. A volute shaped pump casing according to claim 1, wherein the distance L is in the range between 1.8 times the maximum thickness s and 4.5 times the maximum thickness s.

4. A volute shaped pump casing according to claim 1, wherein adjacent to the maximum the splitter rib has a thickness smaller than the maximum thickness s.

5. A volute shaped pump casing according to claim 1, wherein the splitter rib has a leading edge part, and wherein at the leading edge part the inner and outer surface of the splitter rib each have a different angle when the splitter rib is wrapped along a curvature in the volute shaped chamber.

6. A volute shaped pump casing according to claim 1, wherein the splitter rib has a leading edge part, and wherein at the leading edge part the inner and outer surface of the splitter rib are matched to the inner and outer flow approach angle respectively when the splitter rib is wrapped along a curvature in the volute shaped chamber.

7. A volute shaped pump casing according to claim 1, wherein the splitter rib is made from one piece.

8. A volute shaped pump casing according to claim 1, wherein the splitter rib forms an integral part with the volute shaped chamber and/or with the volute shaped pump casing.

9. A centrifugal pump including a volute shaped pump casing according to claim 1.

10. A volute shaped pump casing according to claim 1, wherein the splitter rib includes an optional split caused by a split of the pump casing.

11. A method of manufacturing a volute shaped pump casing for a centrifugal pump with a chamber for housing at least one impeller rotatable around an axis of rotation and with a volute shaped chamber which forms a flow channel and which contains a splitter rib for dividing the flow channel formed, characterized in that the method includes positioning a mean camber line equidistantly between an inner and outer surface of the splitter rib in a section perpendicular to the axis of rotation, varying the thickness of the splitter rib along the mean camber line, providing a maximum in the thickness of the splitter rib for the mean camber line unwrapped to a straight line, with the thickness at said maximum being called maximum thickness s, and positioning said maximum at a distance L from the leading edge of the splitter rib wherein the distance L is larger than 1.4 times the maximum thickness s and smaller than 6 times the maximum thickness s, wherein for a distance from the leading edge of the splitter rib just outside the range of the distance L the thickness of the splitter rib is smaller than the maximum thickness s.

12. A method according to claim 11, wherein the splitter rib is formed from one piece.

13. A method according to claim 11, wherein the volute shaped pump casing and the whole splitter rib or part of the splitter rib are formed together.

14. A method according to claim 11, wherein the volute shaped pump casing and the whole splitter rib or part of the splitter rib are formed by casting.

15. A method according to claim 11, wherein the splitter rib is fully manufactured from metal.

16. A method according to claim 15, wherein the splitter rib is manufactured from coated metal.

17. A method according to claim 15, wherein the splitter rib is manufactured from uncoated metal.

18. A method according to claim 11, wherein the splitter rib includes an optional split caused by a split of the pump casing.

* * * * *